US005576169A

United States Patent [19]

Mariotti et al.

[11] Patent Number: 5,576,169

[45] Date of Patent: Nov. 19, 1996

[54] SILVER BROMOIODIDE CORE-SHELL GRAIN EMULSION

[75] Inventors: Mario Mariotti, Carcare; Bruno Barletta, Serole; Mauro Besio, Vado Ligure, all of Italy

[73] Assignee: Imation Corp., Woodbury, Minn.

[21] Appl. No.: 399,611

[22] Filed: Mar. 7, 1995

[30] Foreign Application Priority Data

Apr. 21, 1994 [EP] European Pat. Off. ..... 94106187

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,477,564 | 10/1984 | Cellone et al. | 430/567 |
| 4,668,614 | 5/1987 | Takada et al. | 430/567 |
| 4,728,602 | 3/1988 | Shibahara et al. | 430/567 |
| 5,266,456 | 11/1993 | Mihayashi et al. | 430/567 |
| 5,284,740 | 2/1994 | Mihayashi et al. | 430/567 |
| 5,420,002 | 5/1995 | Takada et al. | 430/567 |

FOREIGN PATENT DOCUMENTS

| | | |
|---|---|---|
| 0147854 | 7/1985 | European Pat. Off. . |
| 0202784 | 11/1986 | European Pat. Off. . |
| 0299719 | 1/1989 | European Pat. Off. . |
| 0309119 | 3/1989 | European Pat. Off. . |

OTHER PUBLICATIONS

"Photographic Emulsion Grains with Cores," by H. Hirsch, Research Laboratories, Kodak Limited, Wealdstone, Harrow, Middlesex, J Photographic Science, vol. 10, pp. 129–146, 1962.

*Primary Examiner*—Janet C. Baxter
*Attorney, Agent, or Firm*—Mark Litman; Gregory A. Evearitt

[57] ABSTRACT

A core-shell silver bromoiodide emulsion having an inner core portion consisting essentially of silver bromoiodide and an outer shell portion consisting essentially of silver bromoiodide, wherein said inner core portion has a silver iodide content ranging from 30 to 50 mol %, said outer shell portion has a silver iodide content ranging from 1 to 10 mol %, and the average total silver iodide content ranges from 5 to 12 mol %, and wherein the ratio between the area of the X-ray diffraction peak corresponding to said outer shell portion and the area of the X-ray diffraction peak corresponding to said inner core portion is higher than 9:1.

15 Claims, 5 Drawing Sheets

SILVER BROMOIODIDE CORE-SHELL GRAIN EMULSION

FIELD OF THE INVENTION

The present invention relates to photographic silver halide core-shell emulsions. More particularly, the invention relates to high iodide content silver bromoiodide emulsions having grains comprising several phases with different iodide content, which emulsions show better granularity and sensitometric properties.

BACKGROUND OF THE ART

There have been more strict requirements for silver halide emulsions for photographic use, which has increased the demands for the high level photographic characteristics such as, for example, high speed, excellent graininess, high sharpness, low fog, wider exposure latitude range and so on.

The above mentioned requirements have been satisfied by well-known silver bromoiodide grain emulsions having a high silver iodide content in the inner part of the grains and a specific core-shell structure in the grains thereof. It is well known in the photographic art that light absorbing increases in the order of silver chloride, silver bromide and silver iodide, but development activity correspondingly decreases in the same order. By using the above described core-shell silver bromoiodide emulsions, a good balance between light sensitivity and development activity has been obtained.

Examples of core-shell silver bromoiodide emulsion are described in many patent and literature references. For example, U.S. Pat. No. 4,668,614 and U.S. Pat. No. 4,728,602 describe a monodispersed core-shell silver bromoiodide emulsion having a core part comprising a silver iodide content of 10 to 45 mol % and a shell part comprising a silver iodide content lower than 5 mol %, with an average silver iodide content higher than 7 mol %. When examined by X-ray diffractometry, two peaks are evidentiated. The first one corresponding to the high iodide core part, the second one to the low iodide shell part. According to the claimed invention it is preferred to have a ratio between the diffraction intensity of the two peaks in the range of from 1/10 to 3/1, more preferably 1/3 to 3/1.

Similarly, European application EP 299,719 discloses a core-shell silver halide emulsion having a core comprising not less than 10 mol % of silver iodide, at least one shell consisting of silver bromide or silver bromoiodide, the outermost of which has a silver iodide content not higher than 5 mol %, and an average silver iodide content of not less than 10 mol %.

EP 309,119 discloses a core-shell silver halide emulsion having at least three silver bromide or silver bromoiodide phases of different composition. According to a preferred embodiment of the claimed emulsion, the innermost phase has a silver iodide content of at least 10 mol %, the outermost phase has a silver iodide content of not more than 6mol %, and the intermediate phase has a silver iodide content difference with the outermost or innermost phase of at least 3mol %. When examined by X-ray diffraction, the claimed emulsion shows three or more diffraction peaks, each corresponding to a phase containing a different percentage of iodide.

EP 202,784 describes a core-shell type silver halide emulsion having an inner core essentially consisting of silver bromide or silver bromoiodide and a plurality of shells. The outermost shell has a silver iodide content ranging from 0 to 10 mol %, the innermost shell has a silver iodide content at least 6 mol % higher than that of the outermost shell, and an intermediate shell has a silver iodide content is at least 3 mol % lower than that of the innermost shell and at least 3 mol % higher than that of the outermost shell.

Finally, U.S. Pat. No. 4,477,564 describes a multiphase bromoiodide emulsion having an average silver iodide content higher than 12%.

SUMMARY OF THE INVENTION

The present invention relates to a core-shell silver bromoiodide emulsion having an inner core portion consisting essentially of silver bromoiodide and an outer shell portion consisting essentially of silver bromoiodide, wherein said inner core portion has a silver iodide content-ranging from 30 to 50 mol %, said outer shell portion has a silver iodide content ranging from 1 to 10 mol %, and the average total silver iodide content ranges from 5 to 12 mol %, and wherein the ratio between the area of the X-ray diffraction peak corresponding to said outer shell portion and the area of the X-ray diffraction peak corresponding to said inner core portion is higher than 9:1, in a graph of intensity of diffraction versus the angle (2θ) of diffraction.

DETAILED DESCRIPTION OF THE INVENTION

Figure 1:
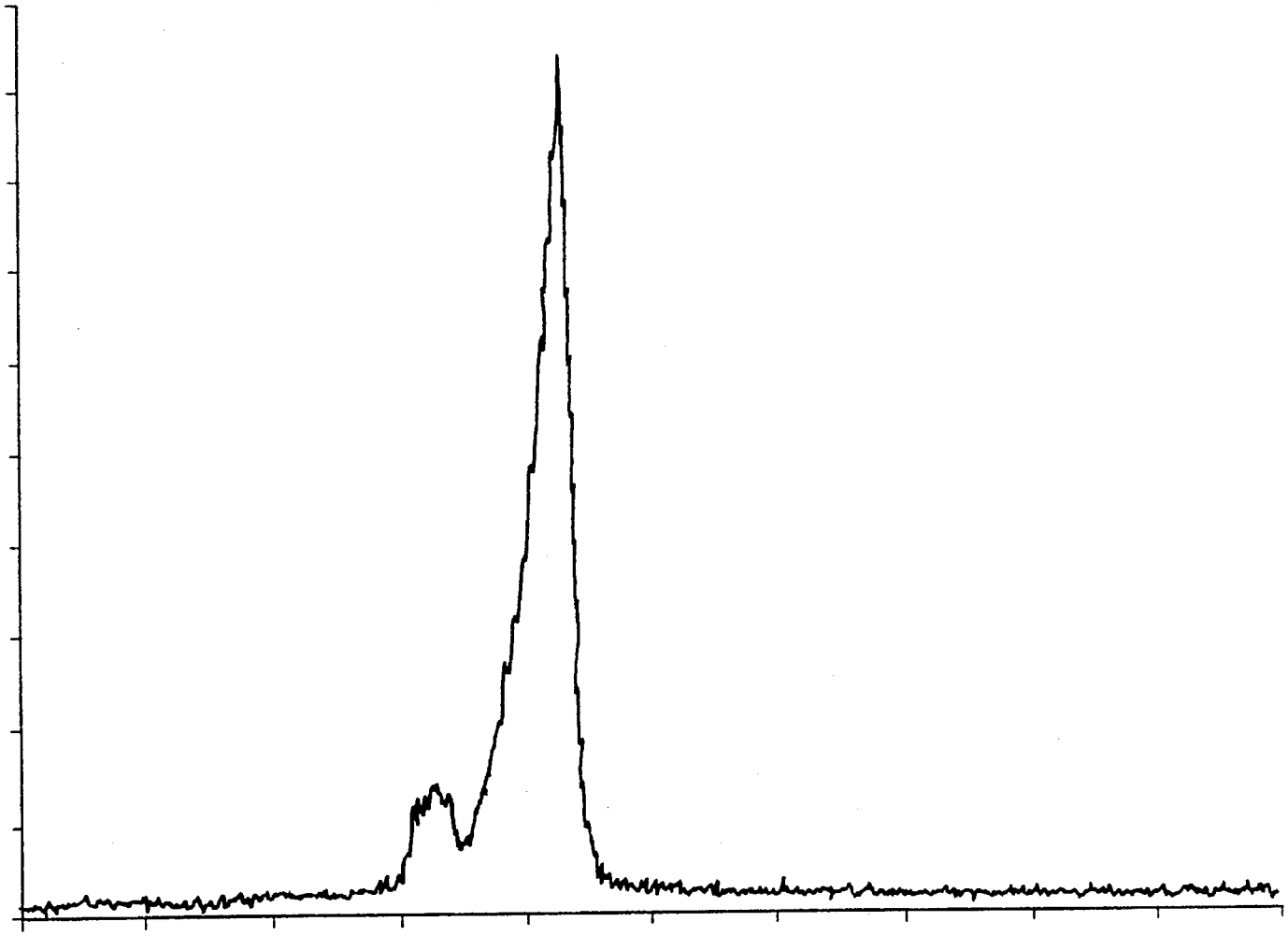
FIGS. 1 to 5 show the X-ray diffraction pattern of silver bromoiodide emulsions 1 to 5, described in the examples, wherein the abscissa indicates the angle of diffraction (2θ) and the ordinate indicates the intensity of diffraction.

The present invention relates to a core-shell silver bromoiodide emulsion having an inner core portion consisting essentially of silver bromoiodide and an outer shell portion consisting essentially of silver bromoiodide, wherein said inner core portion has a silver iodide content ranging from 30 to 50 mol %, said outer shell portion has a silver iodide content ranging from 1 to 10 mol %, and the average total silver iodide content ranges from 5 to 12 mol %, and wherein the ratio between the area of the X-ray diffraction peak corresponding to said outer shell portion and the area of the X-ray diffraction peak corresponding to said inner core portion is higher than 9:1.

The advantages of the present invention appear to be due to the specific ratio of the areas of the X-ray diffraction peaks corresponding to the outer shell portion and the inner core portion. The X-ray diffraction curve of the silver bromoiodide core-shell emulsion of the present invention can be obtained by means of X-ray diffraction. Examples of application of X-ray diffraction method to silver halide grains are described in the literature of H. Hirsh, Journal of Photographic Science, Vol. 10, (1962), p. 129 et seq.

The X-ray diffraction pattern was registered by using a Philips X-Ray Diffractometer 1700, having an X-ray tube PW 22730/20 with a copper anti-cathode, a receiving slit 0.1 mm wide and a-powdered silicon specimen as external standard. The diffraction curves were registered at diffraction angles (2θ) from 40° to 50° corresponding to the (2,2,0) diffraction signals, using CuKα X-ray radiation. The silver bromoiodide gelatin emulsion was enzyme hydrolyzed by mixing about 3 g of the emulsion with 10 ml of L-protease aqueous solution in a centrifuge tube and heated at 40°–50°

C. for one hour. The mixture was centrifuged at 3,500 rpm for 10 minutes, the supernatant liquor discharged and the tube drained by inversion; the silver bromoiodide grains were suspended in 10 ml of deionized water at 40°–50° C., washed by centrifuging and again drained by inversion. Washing was repeated three times. After the last washing, the grains were re-suspended in 2.5 ml of deionized water, and a portion (0.1–0.2 ml) of the mixture was applied on a 4×4 cm glass slide; the specimen was heated at 40°–50° C. until dry.

The silver bromoiodide emulsion of the present invention comprises an outer shell phase and at least one inner core phase. The silver iodide contents of the outer phase and the inner phase differ from each other.

The silver iodide content of the outer shell phase should be in the range of from 1 to 10 mol % relative to the total silver halide content of the outer shell phase, preferably from 3 to 7 mol %.

The silver iodide content of the inner core phase should be in the range of from 30 to 50 mol % relative to the total silver halide content of the inner core phase, preferably from 35 to 42 mol %.

The overall average silver iodide content of the silver bromoiodide emulsion of the present invention should be in the range of from 5 to 12 mol % relative to the total silver halide content of the grains, more preferably from 9 to 2 mol %.

The silver iodobromide grains of the emulsion of the present invention may be regular grains having a regular crystal structure such as cube, octahedron, and tetradecahedron, or the spherical or irregular crystal structure, or those having crystal defects such as twin plane, or those having a tabular form, or the combination thereof.

The term "cubic grains" according to the present invention is intended to include substantially cubic grains, that is silver iodobromide grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver bromoiodide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other iodobromide emulsions according to this invention are those which employ one or more light-sensitive tabular grain emulsions. The tabular silver bromoiodide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver bromoiodide grains suitable for use in this invention range from about 0.3 μm to about 5 μm, preferably 0.5 μm to 3 μm, more preferably 0.8 μm to 1.5 μm. The tabular silver bromoiodide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, US 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine-silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions of the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver bromoiodide emulsion of the present invention can be prepared according to the following processing method:

1. An aqueous solution prepared by dissolving gelatin, an iodide salt, and, optionally a chloride salt in distilled water was provided in a reaction vessel. The solution was stirred by a dispersator and kept at about 20° to 40° C.

2. An aqueous solution of ammonia was optionally added under stirring.

3. To the resulting solution, an aqueous silver salt solution and an aqueous bromide salt solution were added by double jet under stirring, by keeping constant the temperature at about 20° to 40° C. The optionally added ammonia is neutralized with sulfuric acid to a pH of about 6 at the end of the precipitation at a temperature of from 20° to 60°. At the end of precipitation or after neutralization, the temperature was risen to about 70° C.

4. A solution containing bromide and chloride salts could be added to have an excess of bromide and chloride ions depending on the morphology and average diameter to be obtained.

5. To the resulting dispersion, an aqueous silver salt solution and an aqueous bromide salt solution were added by accelerated double jet under stirring. The rate of addition can vary from an initial flow of from 5 to 30 ml/minute, to a final flow of from 20 to 60 ml/minute. The accelerated double jet profile can be linear, quadratic, or step-by-step, by employing silver and bromide salt solutions with different concentrations. Optionally, an iodide salt aqueous solution can be added during the growth.

The silver halide grain emulsion of the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion of the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric add, 2-thiobarbituric acid, rhodanine, hydantoin, 2-thiohydantoin, 2-pirazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The Chemistry of Synthetic Dyes,* Academic Press, New York, 1971, Chapter V, James, *The Theory of the Photographic Process,* 4th Ed., Macmillan, 1977, Chapter 8, F. M. Hamer, *Cyanine Dyes and Related Compounds,* John Wiley and Sons, 1964.

The silver halide emulsion of the present invention can be used for the manufacture of light-sensitive silver halide photographic elements, in particular color negative photographic elements, color reversal photographic elements, and the like.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in silver halide color photo graphic elements include both those substantially colorless and those which are colored ("masked couplers"), The 2-equivalent couplers also include white couplers which do not form any dye on reaction with the color developer oxidation products. The 2-equivalent color couplers include also DIR, couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

The most useful magenta-forming couplers are conventional pyrazolone type compounds, indazolone type compounds, cyanoacetyl compounds, pyrazoletriazole type compounds, etc, and particularly preferred couplers are pyrazoione type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467,and in JP patent applications 20,826/76, 58,922/77, 129,538/74, 74,027/74, 159,336/75, 42,121/77, 74,028/74, 60,233/75, 26,541/76 and 55,122/78.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, and in DE Pat. Appl. No. 3,324,533.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, and in EP Pat. Appl. Nos. 89,843, 117,511, 118,087, 193,389, and 301,477.

Examples of non-color forming DIR coupling compounds which can be used in silver halide color elements include those described in U.S. Pat. Nos. 3,938,996; 3,632,345; 3,639,417; 3,297,445 and 3,928,041; in German patent application Ser. Nos. 2,405,442; 2,523,705; 2,460,202; 2,529,350 and 2,448,063; in Japanese patent application Ser. Nos. 143,538/75 and 147,716/75 and in British patents 1,423,588 and 1,542,705.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

The photographic elements, including a silver halide emulsion according to this invention, may be processed to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenilene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxy-ethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt on an alkali metal or of ammonium and of trivalent iron with an organic acid, e.g. EDTA.Fe.$NH_4$, wherein EDTA is the ethylenediaminotetracetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath contains known fixing agents, such as for example ammonium or alkali metal thiosulfates. Both bleaching and fixing baths can contain other additives, e.g. polyalkyleneoxide derivatives, as described in GB patent 933,008 in order to increase the effectiveness of the bath, or thioethers known as bleach accelerators.

The present invention will be illustrated with reference to the following examples, but it should be understood that these examples do not limit the present invention.

EXAMPLE 1

Preparation of Silver Bromoiodide Emulsion 1 (Invention)

A tabular grain emulsion according to the present invention was prepared according to the following procedure.

An aqueous solution prepared by dissolving 71.4 g of gelatin, 91.7 g of potassium iodide, and 58.6 g of potassium chloride in 2548 g of distilled water was stirred by a dispersator at 3500 rpm and T=30° C. To this solution, 127.4 ml of a 12N solution of ammonia were added always under stirring at 30° C. A double jet addition of 253 ml of a silver nitrate solution (2.25N) and 169 ml of an ammonium bromide solution (2.25N) was performed at constant flow rate in ten minutes. Following the addition of silver and bromide salts the temperature was increased for 25 minutes until to 55° C. After that, the ammonia was neutralized by sulfuric acid solution (25% by weight) to a pH of 6.0 and then, the temperature rose to 70° C. in ten minutes. A solution containing 28 g of ammonium bromide and 30.6 g of potassium chloride was subsequently added. Finally, 1794 ml of a 2.25N ammonium bromide solution and 1794 ml of a 2.25N silver nitrate solution were added in 110 minutes by accelerated flow rate (quadratic ramp). The initial flow rate was 12.5 ml/min and the final flow rate was 24 ml/min.

The emulsion was then ultrafiltrated and reconstituted with 190 g of gelatin to a silver to gelatin ratio equal to about 2.0. The average diameter of the silver bromoiodide grains was about 1.4 μm, with an average aspect ratio of 2.1:1. FIG. 1 shows the X-ray diffraction pattern of emulsion 1 measured with the method disclosed in the specification.

EXAMPLE 2

Preparation of Silver Bromoiodide Emulsion 2 (Invention)

A tabular grain emulsion according to the present invention was prepared according to the following procedure.

An aqueous solution prepared by dissolving 95.3 g of gelatin, 163.1 g of potassium iodide, and 30.0 g of potassium chloride in 3150 g of distilled water was stirred by a dispersator at 30° C. To this solution, 127.4 ml of a 12N solution of ammonia were added always under stirring at 30° C. A double jet addition of 253 ml of a silver nitrate solution (4.0N) and 81.4 ml of an ammonium bromide solution (4.0N) was performed at constant flow rate in ten minutes. Following the addition of silver and bromide salts, the ammonia was neutralized by sulfuric acid solution (25% by weight) to a pH of 6.0 and then, the temperature rose to 60° C. in twenty minutes. Finally, 1794 ml of a 4.0N ammonium bromide solution and a 2.25N silver nitrate solution were added in 52 minutes by accelerated flow rate (quadratic ramp). The initial flow rate was 26.4 ml/min and the final flow rate was 50.7 ml/min.

Figure 2:
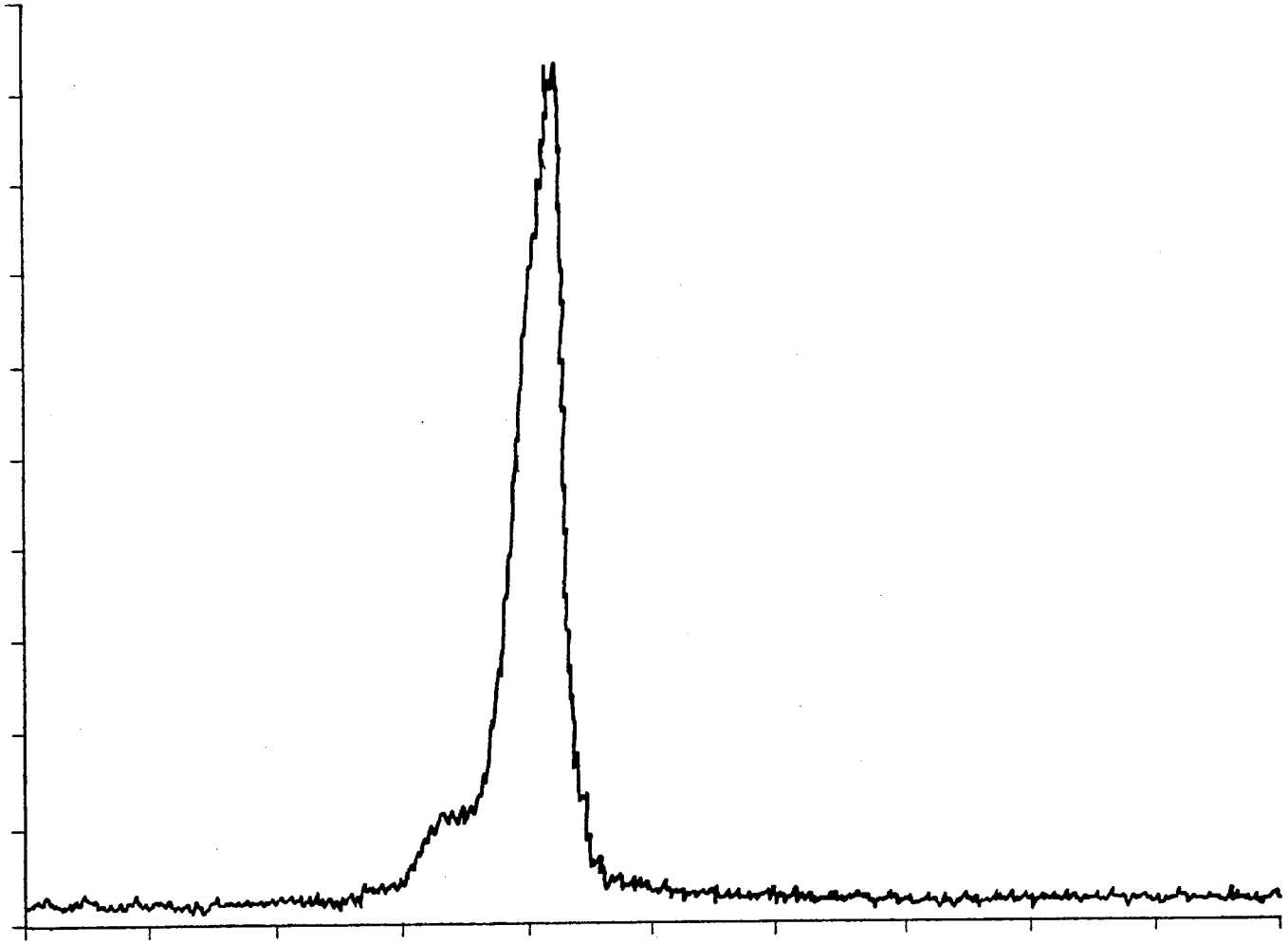

The emulsion was then ultrafiltrated and reconstituted with 366 g of gelatin to a silver to gelatin ratio equal to about 2.0. The average diameter of the silver bromoiodide grains was about 0.8 μm, with an average aspect ratio of 3:1. FIG. 2 shows the X-ray diffraction pattern of emulsion 2 measured with the method disclosed in the specification.

EXAMPLE 3

Preparation of Silver Bromoiodide Emulsion 3 (Invention)

A tabular grain emulsion according to the present invention was prepared according to the following procedure.

An aqueous solution prepared by dissolving 71.4 g of gelatin, 46 g of potassium iodide, and 58.6 g of potassium chloride in 2548 g of distilled water was stirred by a dispersator at 30° C. To this solution, 127.4 ml of a 12N solution of ammonia were added under constant stirring at 4500 rpm and T=30° C. A double jet addition of 253 ml of a silver nitrate solution (2.25N) and 169 ml of an ammonium bromide solution (2.25N) was performed at constant flow rate in ten minutes. Following the addition of silver and bromide salts the temperature was increased for 25 minutes until to 55° C. After that, the ammonia was neutralized by sulfuric acid solution (25% by weight) to a pH of 6.0 and then, the temperature rose to 70° C. in ten minutes. A solution containing 28 g of ammonium bromide and 30.6 g of potassium chloride was subsequently added. Finally, 1810 ml of a 2.25N ammonium bromide solution and a 2.25N silver nitrate solution were added in 60 minutes by accelerated flow rate (linear ramp). The initial flow rate was 20.0 ml/min and the final flow rate was 40.3 ml/min. After 5minutes from the start of the growth stage, 46 g of KI was quickly added to the reaction vessel.

Figure 3:
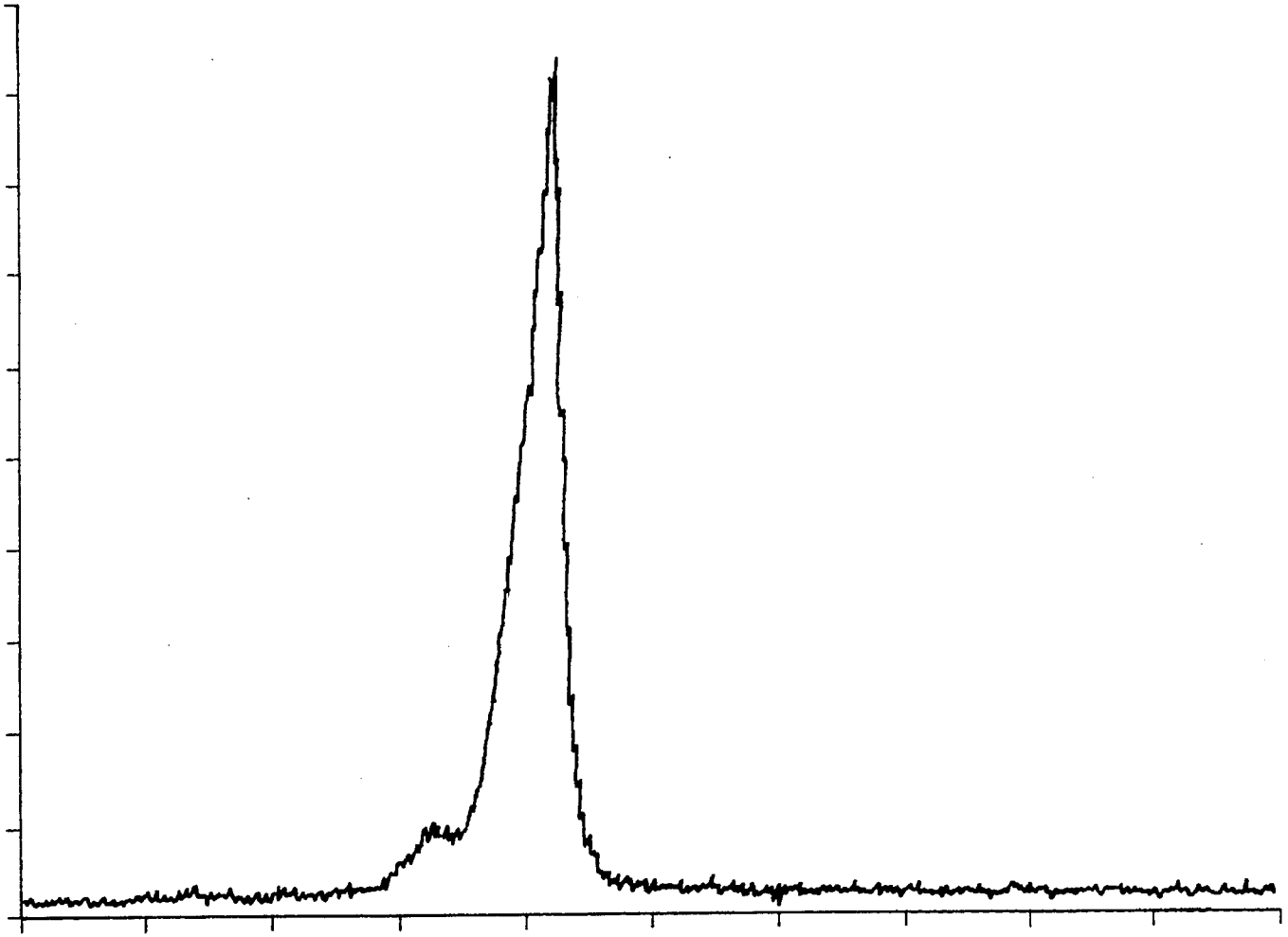

The emulsion was then ultrafiltrated and reconstituted with 190 g of gelatin to a silver to gelatin ratio equal to about 2.0. The average diameter of the silver bromoiodide grains was about 1.4 μm, with an average aspect ratio of about 4.65:1. FIG. 3 shows the X-ray diffraction pattern of emulsion 3 measured with the method disclosed in the specification.

EXAMPLE 4

Preparation of Silver Bromoiodide Emulsion 4 (Comparison)

A comparison tabular grain emulsion was prepared according to the following procedure.

An aqueous solution prepared by dissolving 71.4 g of gelatin, 91.7 g of potassium iodide, and 58.6 g of potassium chloride in 2548 g of distilled water was stirred by a dispersator at 30° C. To this solution, 127.4 ml of a 12N solution of ammonia were added under constant stirring at 3500 rpm and T=30° C. A double jet addition of 253 ml of a silver nitrate solution (2.25N) and 169 ml of an ammonium bromide solution (2.25N) was performed at constant flow rate in ten minutes. Following the addition of silver and bromide salts the temperature was increased for 25 minutes to 55° C. After that, the ammonia was neutralized by sulfuric acid solution (25% by weight) to a pH of 6.0 and then, the temperature was raised to 70° C. in ten minutes. A solution containing 28 g of ammonium bromide and 30.6 g of potassium chloride was subsequently added. Finally, 1794 ml of a 2.25N ammonium bromide solution and a 2.25N silver nitrate solu tion were added in 52 minutes by accelerated flow rate (quadratic ramp). The initial flow rate was 26.4 ml/min and the final flow rate was 50.7 ml/min.

Figure 4:
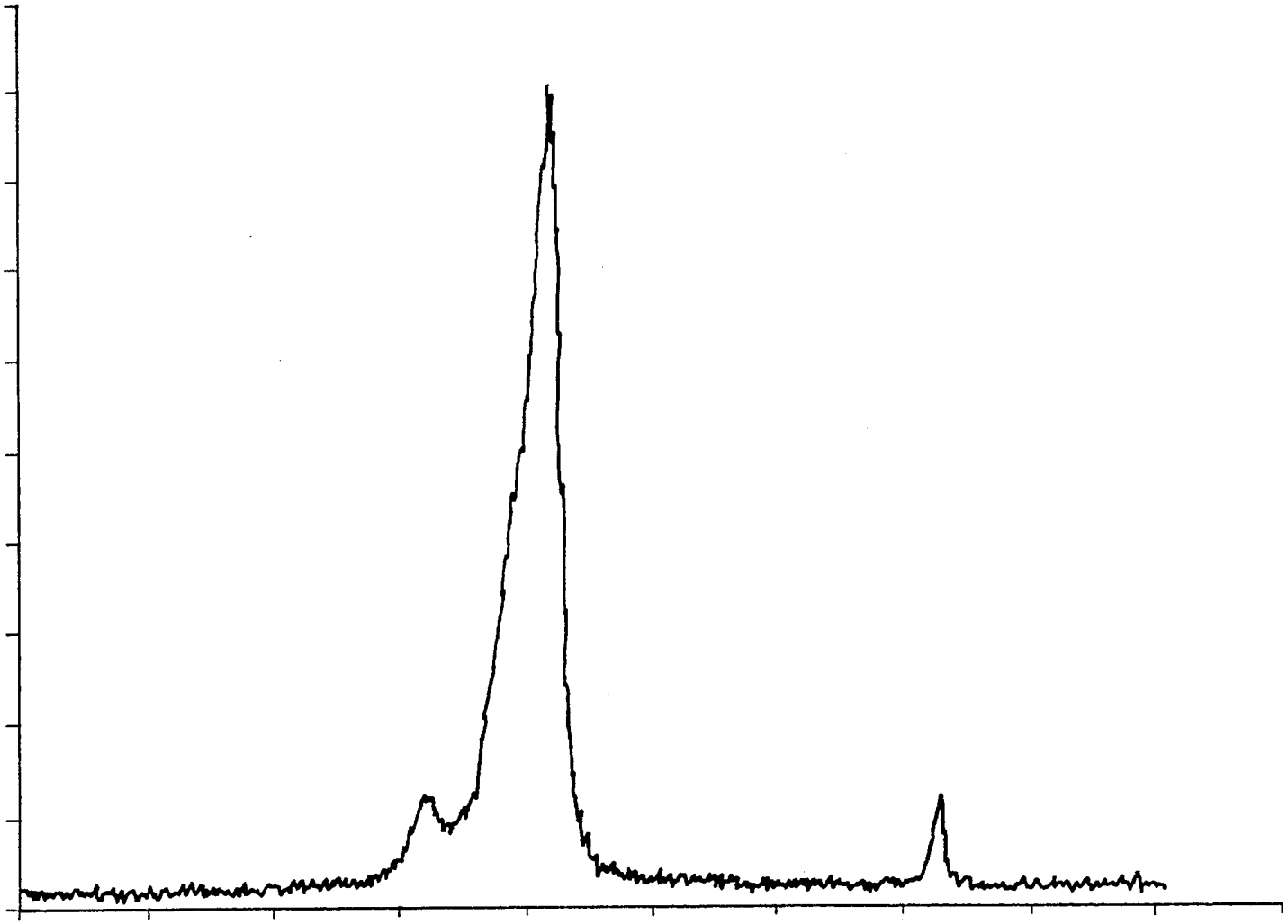

The emulsion was then ultrafiltrated and reconstituted with 190 g of gelatin to a silver to gelatin ratio equal to about 2.0. The average diameter of the silver bromoiodide grains was about 1.1 μm, with an average aspect ratio of about 2.3:1. FIG. 4 shows the X-ray diffraction pattern of emulsion 4 measured with the method disclosed in the specification.

EXAMPLE 5

Preparation of Silver Bromoiodide Emulsion 5 (Comparison)

A comparison octahedral grain emulsion was prepared according to the following procedure.

Figure 5:
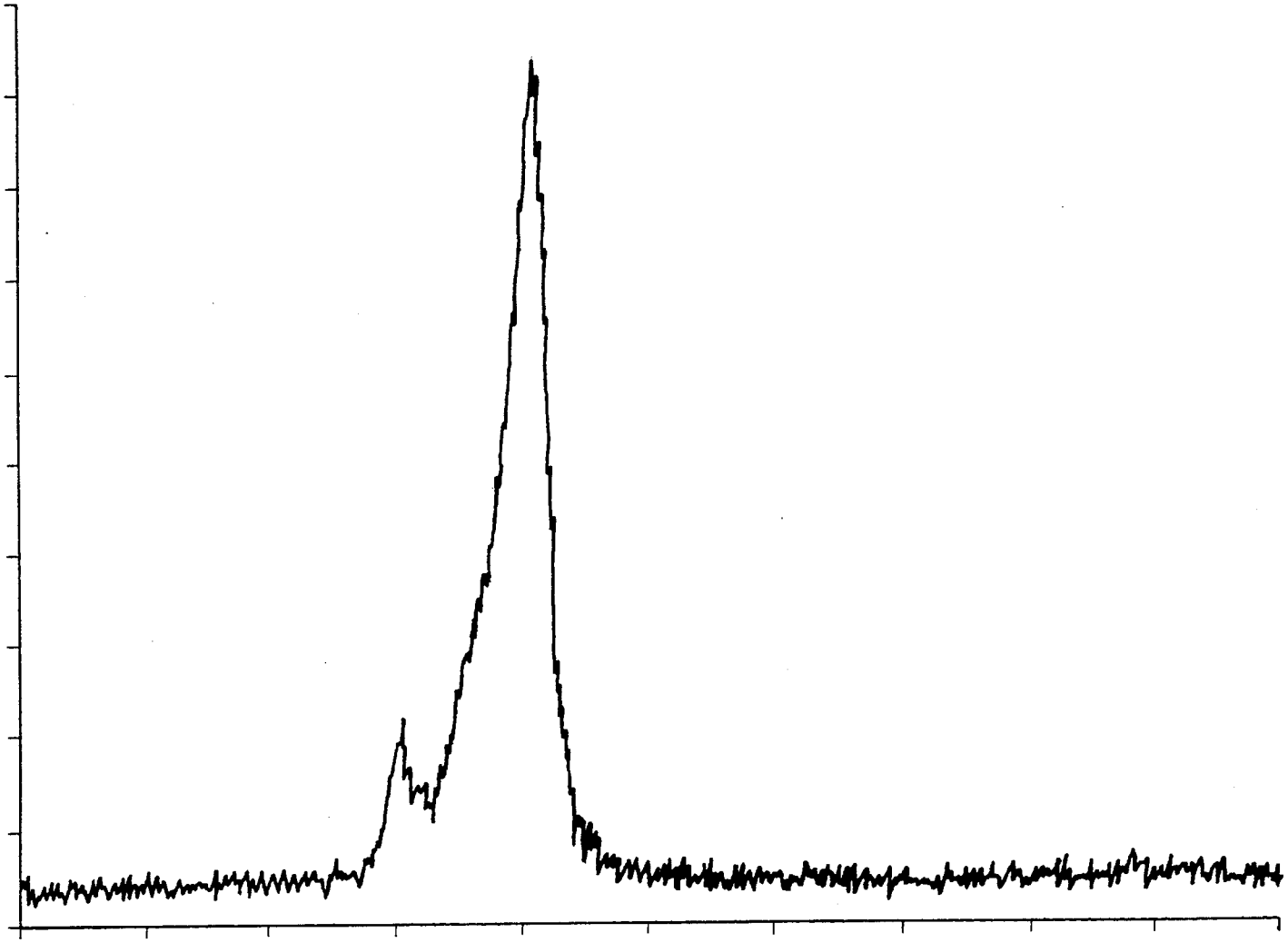

This emulsion was prepared according to example 1 of Cellone et al. U.S. Pat. No. 4,477,564. FIG. 5 shows the X-ray diffraction pattern of emulsion 5 measured with the method disclosed in the specification.

EXAMPLE 6

In the following Table 1 are reported the main physical parameters of the above described emulsions.

TABLE 1

| Emulsion | AgI % Core | AgI % Shell | Ratio L/H | Average AgI % | Average Diameter |
|---|---|---|---|---|---|
| 1 (I) | 38.7 | 3.7 | 11.27 | 12 | 1.40 μm |
| 2 (I) | 36.5 | 6.4 | 10.24 | 12 | 0.80 μm |
| 3 (I) | 36.0 | 5.0 | 11.96 | 12 | 1.40 μm |
| 4 (C) | 37.9 | 5.6 | 8.69 | 12 | 1.08 μm |
| 5 (C) | 48.0 | 7.0 | 7.34 | 14 | 1.10 μm |

(I) = Invention
(C) = Comparison

The L/H ratio represents the ratio between the area of the peak corresponding to the Low Iodide (LI) phase and the area of the peak corresponding to the High Iodide (HI) phase. As shown in FIG. 1, in order to calculate the two areas, a perpendicular to the abscissa starting from the minimum between the two peaks, and a base line corresponding to the noise signal are drafted. In this way the diffraction curve and the drafted lines define two areas (L and H) under the LI and HI phase peaks, from which the ratio L/H can be calculated.

All the emulsions were optimally chemically digested with gold and sulfur using p-toluenethiosulfonic acid, p-toluenesulfinic acid and gold tetrachloroaurate complexed with potassium thiocyanate.

A yellow and a magenta monochrome film was obtained from each emulsion 1 to 5 by using blue sensitizing dye S-6 or green sensitizing dyes S-4 and S-5, and conventional coating formulation. The silver coverage of the yellow layer and the magenta layer was 1.30 and 2.00 g Ag/m$^2$, respectively. Samples of each film were exposed to a white light source having a color temperature of 5,500 Kelvin. All the exposed samples were developed in a standard type C41 process as described in British Journal of Photography, Jul. 12, 1974, pp. 597–598. The sensitometric results are showed in the following Tables 2 and 3.

The data of Table 2 and 3 show the superior sensitometric characteristics of the emulsions of the present invention have in regard comparison emulsions. In particular emulsions 1 and 3 of the invention give higher speed and Dmax together with a lower fog in both the yellow and magenta films. The superior results of emulsion 2 are more evident in magenta layer, wherein a better Dmax is obtained with a little improvement of fog and speed. When used in yellow layer, emulsion 2 gives a lower speed but a significant improvement in terms of fog and Dmax.

TABLE 2

| | YELLOW LAYER | | |
|---|---|---|---|
| Coating emulsion | Fog | Dmax | Speed |
| 1 (I) | 0.11 | 1.45 | 2.71 |
| 2 (I) | 0.11 | 2.37 | 2.24 |
| 3 (I) | 0.12 | 2.31 | 2.73 |
| 4 (C) | 0.13 | 2.16 | 2.67 |
| 5 (C) | 0.20 | 1.51 | 2.63 |

(I) = Invention
(C) = Comparison

TABLE 3

| | MAGENTA LAYER | | |
|---|---|---|---|
| Coating emulsion | Fog | Dmax | Speed |
| 1 (I) | 0.22 | 1.72 | 2.33 |
| 2 (I) | 0.21 | 2.47 | 2.13 |
| 3 (I) | 0.21 | 2.58 | 2.25 |
| 4 (C) | 0.20 | 2.25 | 2.14 |
| 5 (C) | 0.24 | 1.62 | 2.11 |

(I) = Invention
(C) = Comparison

EXAMPLE 7

A silver halide color photographic film A was prepared by coating a cellulose triacetate support base, subbed with gelatin, with the following layers in the following order:

(a) a layer of black colloidal silver dispersed in gelatin having a silver coverage of 0.27 g/m$^2$ and a gelatin coverage of 1.33 g/$^2$;

(b) an intermediate layer containing 0.97 g/m$^2$ of gelatin;

(c) a layer of low sensitivity red-sensitive silver halide emulsion comprising a sulfur and gold sensitized low-sensitivity silver bromoiodide emulsion optimally spectrally sensitized with sensitizing dyes S-1, S-2 and S-3 (having 2.5% silver iodide moles and a mean grain size of 0.18 μm) at a total silver coverage of 0.71 g/m$^2$, gold coverage of 19.42 μmole/mole Ag and a gelatin coverage of 0.94 g/m$^2$, containing the cyan-dye forming coupler C-1 (containing a cyano group) at a coverage of 0.354 g/m$^2$, the cyan-dye forming DIR coupler C-2 at a coverage of 0.024 g/m$^2$ and the magenta colored cyan-dye forming coupler C-3 at a coverage of 0.043 g/m$^2$, dispersed in a mixture of tricresylphosphate and butylacetanilide;

(d) layer of medium-sensitivity red-sensitive silver halide emulsion comprising a sulfur and gold sensitized silver chloro-bromo-iodide emulsion optimally spectrally sensitized with sensitizing dyes S-1, S-2 and S-3 (having 7% silver iodide moles and 5% silver chloride moles and a mean grain size of 0.45 μm) at a silver coverage of 0.84 g/m$^2$, gold coverage of 7.67 μmole/mole Ag and a gelatin coverage of 0.83 g/m$^2$, containing the cyan-dye forming coupler C-1 (containing a cyano group) at a coverage of 0.333 g/m$^2$, the cyan-dye forming DIR coupler C-2 at a coverage of 0.022 g/m$^2$ and the magenta colored cyan-dye forming coupler C-3 at a coverage of 0.052 g/m$^2$, dispersed in a mixture of tricresylphosphate and butylacetanilide;

(e) a layer of high-sensitivity red-sensitive silver halide emulsion comprising the sulfur and gold sensitized silver bromo-iodide emulsion 4 optimally spectrally sensitized with sensitizing dyes S-1, S-2 and S-3 at a silver coverage of 1.54 g/m$^2$, gold coverage of 2.81 μmole/mole Ag and a gelatin coverage of 1.08 g/m$^2$, containing two cyan-dye forming couplers, the coupler C-1 (containing a cyano group) at a coverage of 0.224 g/m$^2$ and the coupler C-4 at a coverage of 0.032 g/m$^2$, and the cyan-dye forming DIR coupler C-2 at a coverage of 0.018 g/m$^2$, dispersed in a mixture of tricresylphosphate and butylacetanilide;

(f) an intermediate layer containing 1.11 g/m$^2$ of gelatin, comprising the 2-chloro-4,6-dihydroxy-1,3,5-triazine gelatin hardener H-1 at a coverage of 0.183 g/m$^2$;

(g) a layer of low sensitivity green sensitive silver halide emulsion comprising a blend of 63% w/w of the low-sensitivity emulsion of layer c) and 37% w/w of the medium-sensitivity emulsion of layer (d) optimally spectrally sensitized with sensitizing dyes S-4 and S-5 at a silver coverage of 1.44 g/m$^2$, gold coverage of 29.7 μmole/mole Ag and a gelatin coverage of 1.54 g/m$^2$, containing the magenta-dye forming coupler M-1, at a coverage of 0.537 g/m$^2$, the magenta dye forming DIR coupler M-2 at a coverage of 0.017 g/m$^2$, and the yellow colored magenta dye forming coupler M-3 at a coverage of 0.079 g/m$^2$, the yellow colored magenta dye forming coupler M-4 at a coverage of 0.157 g/m$^2$, and dispersed in tricresylphosphate;

(h) a layer of high-sensitivity green sensitive silver halide emulsion comprising the sulfur and gold sensitized silver bromo-iodide emulsion 4 optimally spectrally sensitized with sensitizing dyes S-4 and S-5 at a silver coverage of 1.60 g/m$^2$, gold coverage of 2.92 μmole/mole Ag and a gelatin coverage of 1.03 g/m$^2$ containing the magenta dye forming coupler M-1, at a coverage of 0.498 g/m$^2$, the magenta dye forming DIR coupler M-2 at a coverage of 0.016 g/m$^2$, the yellow colored magenta dye forming coupler M-3 at a coverage of 0.021 g/m$^2$, and the yellow colored magenta dye forming coupler M-4 at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising the 2,4-dichloro-6-hydroxy-1,3,5-triazine gelatin hardener H-1 at a coverage of 0.148 g/m$^2$;

(k) a layer of low-sensitivity blue-sensitive silver halide emulsion comprising a blend of 60% w/w of the low-sensitivity emulsion of layer c) and 40% w/w of the medium-sensitivity emulsion of layer (d) optimally spectrally sensitized with sensitizing dye S-6 at a silver coverage of 0.53 g/m$^2$, gold coverage of 12.32 μmole/mole Ag and a gelatin coverage of 1.65 g/m$^2$ and the yellow dye forming coupler Y-1 at a coverage of 1.042 g/m$^2$ and the yellow dye forming DIR coupler Y-2 at a coverage of 0.028 g/m$^2$ dispersed in a mixture of diethyllaurate and dibuthylphthalate;

(l) a layer of high-sensitivity blue sensitive silver halide emulsion comprising a 1:1 blend of sulfur and gold sensitized silver bromo-iodide emulsions 1 and 4 optimally spectrally sensitized with sensitizing dye S-6 at a silver coverage of 0.90 g/m$^2$, gold coverage of 1.64 μmole/mole Ag and a gelatin coverage of 1.24 g/m$^2$, containing the yellow dye-forming coupler Y-1 at a coverage of 0.791 g/m$^2$ and the yellow dye forming DIR coupler Y-2 at a coverage of 0.021 g/m$^2$ dispersed in a mixture of diethyllaurate and dibuthyl-phthalate;

(m) a protective layer of 1.28 g/m$^2$ of gelatin, comprising the UV absorber UV-1 (containing two cyano groups) at a coverage of 0.1 g/m$^2$; and (n) a top coat layer of 0.73 g/m$^2$ of gelatin containing 0.273 g/m$^2$ of polymethylmethacrylate matting agent MA-1 in form of beads having an average diameter of 2.5 micrometers, and the 2,4-dichloro-6-hydroxy-1,3,5-triazine hardener H-1 at a coverage of 0.468 g/m$^2$. The total silver coverage of the silver halide emulsion layers was 6.99 g/m$^2$ and the total gold coverage was 4.97 μmole/m$^2$.

Film B was prepared in a similar manner, but employing the sulfur and gold sensitized silver bromo-iodide emulsion 1 in the layers e) and h).

Film C was prepared in a similar manner, but employing the sulfur and gold sensitized silver bromo-iodide emulsion 3 in the layers e) and h).

Films A, B, and C were exposed to white light and developed in conventional development processing. The sensitometric results, together with the graininess values are summarized in Table 4.

TABLE 4

| | Cyan layer | | | Magenta layer | | | |
|---|---|---|---|---|---|---|---|
| FILM | D-min | Dmax | Speed | Dmin | Dmax | Speed | Graininess |
| A | 0.27 | 2.09 | 2.35 | 0.59 | 2.66 | 2.51 | 12 |
| B | 0.28 | 2.03 | 2.39 | 0.59 | 2.44 | 2.52 | 13 |
| C | 0.26 | 2.08 | 2.47 | 0.55 | 2.58 | 2.59 | 12 |

The graininess has been evaluated at a color density of 1.0 over the minimum density. The results clearly show the improvement in terms of speed/graininess relationship of the emulsions 1 to 3 of the present invention. The films B and C prepared with the emulsions of the present invention show a graininess substantial equal to that of film A, but have a higher speed in both the cyan and magenta layers.

Formulas of compounds used in the present invention will be presented below.

Cyan dye forming coupler C-1:

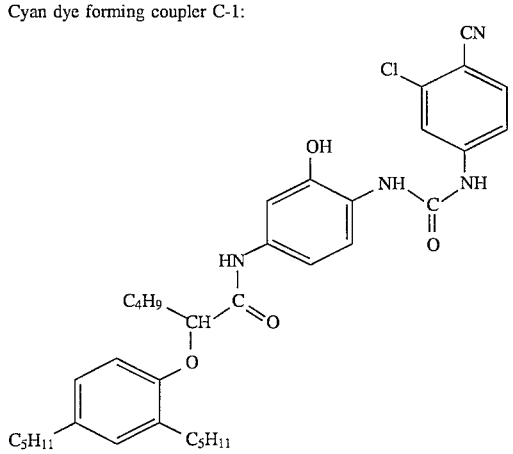

Cyan dye forming DIR coupler C-2:

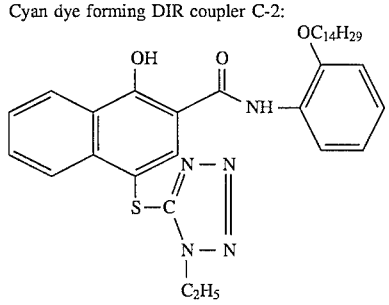

-continued
Magenta colored cyan dye forming coupler C-3:
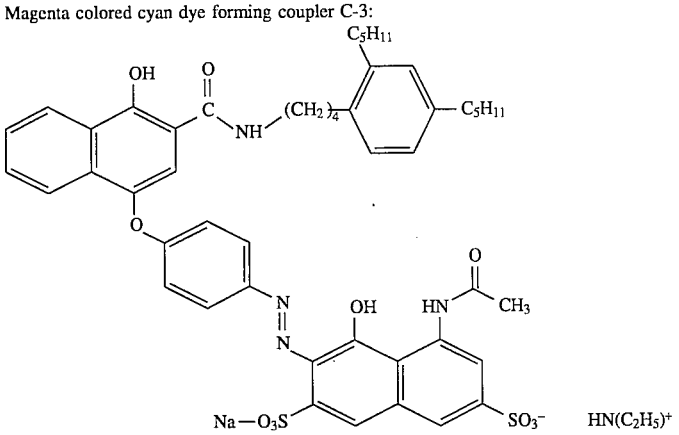
Cyan dye forming coupler C-4:
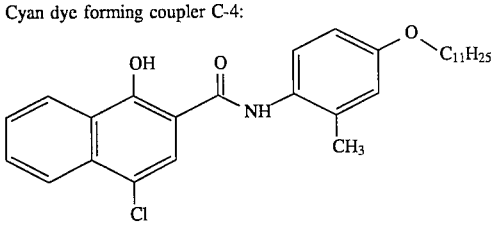
Magenta dye forming coupler M-1:
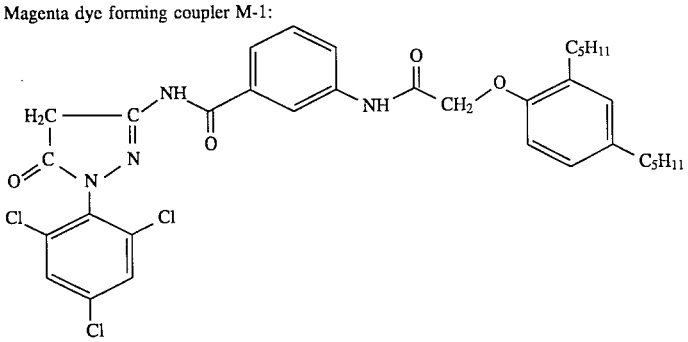
Magenta dye forming DIR coupler M-2:
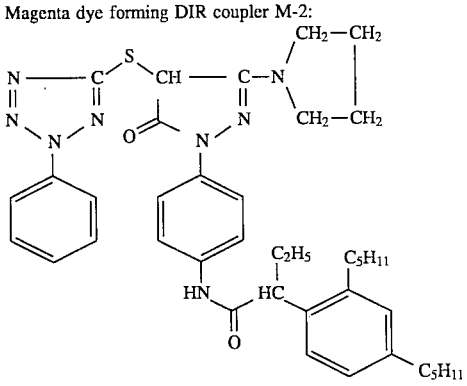

-continued
Yellow colored magenta dye forming coupler M-3:
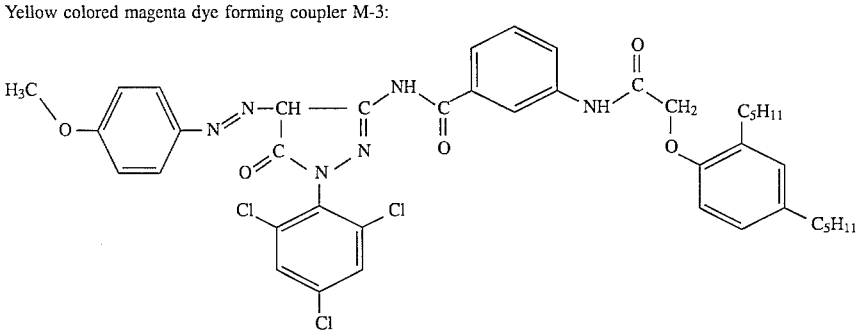
Yellow colored magenta dye forming coupler M-4:
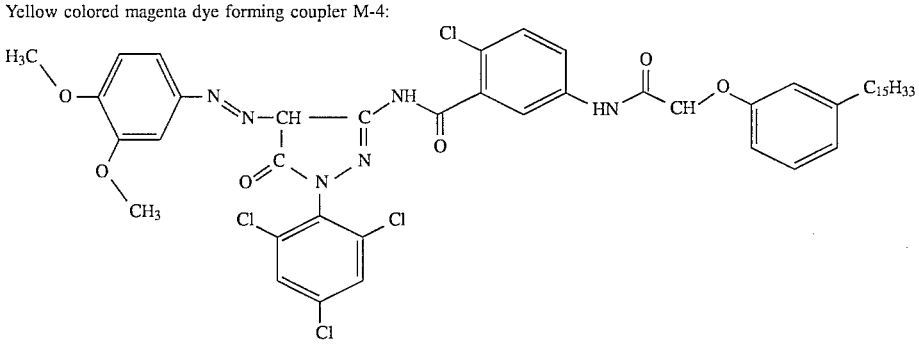
Yellow dye forming coupler Y-1:
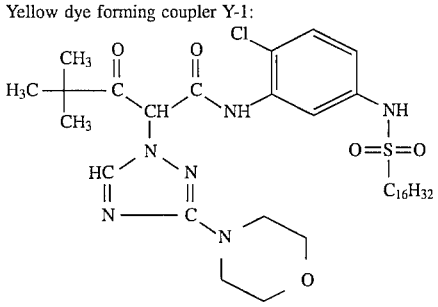
Yellow dye forming DIR coupler Y-2:
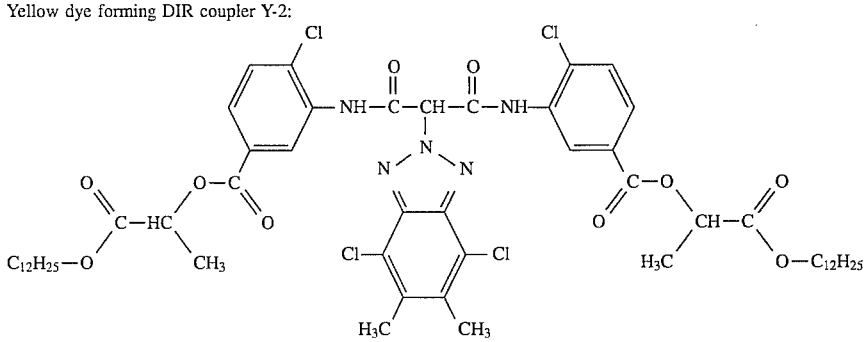
Red Sensitizer S-1
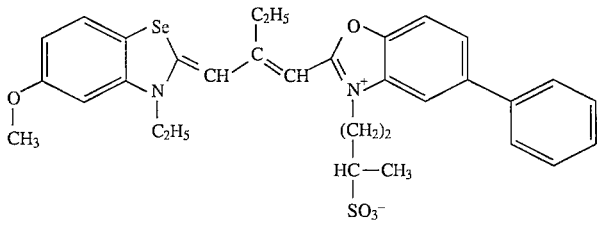

-continued
Red Sensitizer S-2
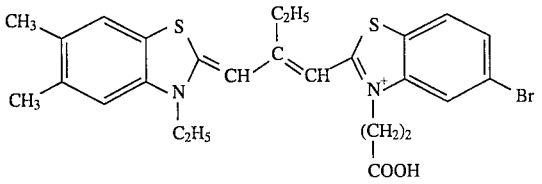
Red Sensitizer S-3
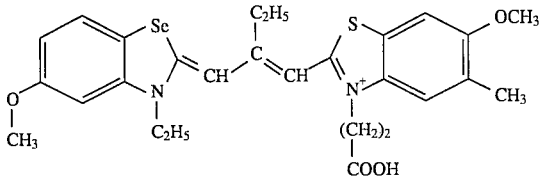
Green Sensitizer S-4
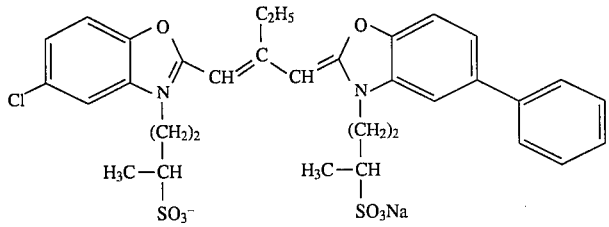
Green Sensitizer S-5
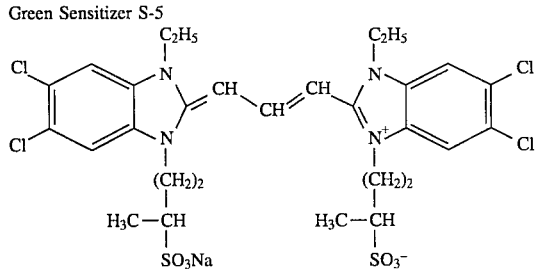
Blue Sensitizer S-6
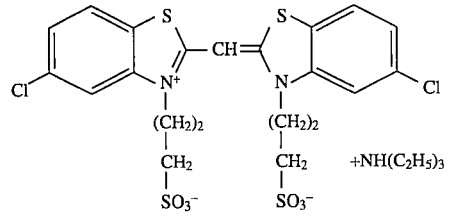
UV absorber UV-1:
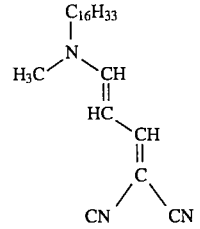
Matting agent MA-1:
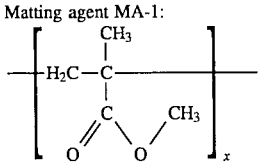

-continued

Hardener H-1:

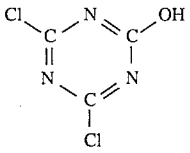

We claim:

1. A core-shell silver bromoiodide emulsion having an inner core portion consisting essentially of silver bromoiodide and an outer shell portion consisting essentially of silver bromoiodide, wherein said inner core portion has a silver iodide content ranging from 30 to 50 mol %, said outer shell portion has a silver iodide content ranging from 1 to 10 mol %, and the average total silver iodide content ranges from 5 to 12 mol %, and wherein the ratio between the area of the X-ray diffraction peak corresponding to said outer shell portion and the area of the X-ray diffraction peak corresponding to said inner core portion is higher than 9:1.

2. The silver bromo-iodide emulsion according to claim 1 characterized in that said inner core portion has a silver iodide content ranging from 35 to 42 mol %.

3. The silver bromo-iodide emulsion according to claim 1 characterized in that said outer shell portion has a silver iodide content ranging from 3 to 7 mol %.

4. The silver bromo-iodide emulsion according to claim 1 characterized in that said average total silver iodide content ranges from 9 to 12 mol %.

5. The silver bromo-iodide emulsion according to claim 1 characterized in that said emulsion comprises tabular grains.

6. The silver bromo-iodide emulsion according to claim 5 characterized in that said tabular grain emulsion has an average aspect ratio higher than 2:1.

7. The silver bromo-iodide emulsion according to claim 5 characterized in that the projective area of said tabular grains accounts for at least 50% based on the projective area of all grains.

8. A silver halide photographic material comprising a support and at least one light-sensitive silver halide emulsion layer coated thereon, characterized in that at least one of said light-sensitive silver halide emulsion layers comprises a core-shell silver bromoiodide emulsion having an inner core portion consisting essentially of silver bromoiodide and an outer shell portion consisting essentially of silver bromoiodide, wherein said inner core portion has a silver iodide content ranging from 30 to 50 mol %, said outer shell portion has a silver iodide content ranging from 1 to 10 mol %, and the average total silver iodide content ranges from 5 to 12 mol %, and wherein the ratio between the area of the diffraction peak corresponding to said outer shell portion and the area of the diffraction peak corresponding to said inner core portion is higher than 9: 1.

9. The silver halide photographic material according to claim 8 characterized in that said inner core portion has a silver iodide content ranging from 35 to 42 mol %.

10. The silver halide photographic material according to claim 8 characterized in that said outer shell portion has a silver iodide content ranging from 3 to 7 mol %.

11. The silver halide photographic material according to claim 8 characterized in that said average total silver iodide content ranges from 9 to 12 mol %.

12. The silver halide photographic material according to claim 8 characterized in that said emulsion comprises tabular grains.

13. The silver halide photographic material according to claim 12 characterized in that said tabular grains have an average aspect ratio higher than 2:1.

14. The silver halide photographic material according to claim 12 characterized in that the projective area of said tabular grains accounts for at least 50% based on the projective area of all grains.

15. The silver halide photographic material according to claim 12 characterized in that said silver halide photographic material is a color photographic material comprising a support and at least one red-sensitized silver halide emulsion layer, at least one green-sensitized silver halide emulsion layer, and at least one blue-sensitized silver halide emulsion layer coated thereon.

* * * * *